US007169062B2

(12) United States Patent
Chen

(10) Patent No.: US 7,169,062 B2
(45) Date of Patent: Jan. 30, 2007

(54) GOLF CLUB HEAD HAVING UNIFORM DEFORMATION STRUCTURE

(75) Inventor: Yun-Fang Chen, Taoyuan Hsien (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 169 days.

(21) Appl. No.: 10/958,496

(22) Filed: Oct. 6, 2004

(65) Prior Publication Data

US 2006/0073906 A1 Apr. 6, 2006

(51) Int. Cl.
*A63B 53/04* (2006.01)

(52) U.S. Cl. ..... 473/342; 473/329

(58) Field of Classification Search ..... 473/324–350
See application file for complete search history.

(56) References Cited

U.S. PATENT DOCUMENTS 5,154,425 A * 10/1992 Niskanen et al. ..... 473/342
5,497,993 A * 3/1996 Shan ..... 473/329
D387,405 S * 12/1997 Solheim et al. ..... D21/759
6,162,133 A * 12/2000 Peterson ..... 473/345
2003/0144079 A1 7/2003 Yoneyama
2004/0132544 A1* 7/2004 Doi ..... 473/345

FOREIGN PATENT DOCUMENTS

JP 09154985 A * 6/1997
JP 09225075 A * 9/1997

* cited by examiner

*Primary Examiner*—Eugene Kim
*Assistant Examiner*—Alvin A. Hunter, Jr.
(74) *Attorney, Agent, or Firm*—Birch, Stewart, Kolasch & Birch, LLP.

(57) ABSTRACT

A golf club head includes a golf club head body, a striking plate and a plurality of equal-length buffers. In assembling, the striking plate mechanically connects to a front side of the golf club head body. Each of the equal-length buffers radially extends from an outer periphery to a center portion on a rear surface of the striking plate, and performs identical elastic deformation. Each of the equal-length buffers has an inner end adapted to commonly delimit a configuration for a striking zone substantially similar to that of the outer periphery of the striking plate.

4 Claims, 6 Drawing Sheets

GOLF CLUB HEAD HAVING UNIFORM DEFORMATION STRUCTURE

BACKGROUND OF THE INVENTION

1. Field of the Invention

The present invention relates to a golf club head having a uniform deformation structure. Particularly, the present invention relates to a striking plate of the golf club head having a plurality of equal-length buffers each of which is extended from a center portion to an outer periphery on a rear surface of the striking plate. More particularly, the present invention also relates to each of the equal-length buffers of the striking plate having an inner end for commonly delimiting a configuration for a striking zone.

2. Description of the Related Art

Referring initially to FIG. 1, U.S. Patent Application Publication No. 2003/0144079 discloses a conventional golf club head structure typically including a golf club head body 1 and a striking plate 2. The striking plate 2 mechanically and securely connects to the golf club head body 1 to constitute a golf club head. Generally, the striking plate 2 includes a plurality of support ribs 20 and a central thick-walled portion 21 surrounded with the support rib 20 on its rear surface. Each of the support ribs 20 radially extends from a center portion to an outer periphery of the striking plate 2, and further connects to an edge of the central thick-walled portion 21.

Referring again to FIG. 1, the support rib 20 of the striking plate 2 consists of a plurality of horizontal narrow ribs 20*a* and a plurality of vertical narrow ribs 20*b*. The number of the horizontal narrow ribs 20*a* is less than that of the vertical narrow ribs 20*b*. Each of the horizontal narrow ribs 20*a* has a length substantially greater than that of each of the vertical narrow ribs 20*b*. In addition, the thickness of each of the support ribs 20 proximate the center of the striking plate 2 is slightly greater than that proximate the outer periphery of the striking plate 2. Namely, the thickness of each of the support ribs 20 is gradually reduced from an inner end to an outer end. Accordingly, each of the vertical narrow ribs 20*b* performs a resilient force higher than that of each of the horizontal narrow ribs 20*a*. Consequently, the horizontal narrow rib 20*a* and the vertical narrow ribs 20*b* are mismatched in elastic deformation.

Simply, there is a resilient difference between the horizontal narrow rib 20*a* and the vertical narrow ribs 20*b* of the striking plate 2. Accordingly, uneven elastic deformation of the striking plate 2 may occur around the central thick-walled portion 21 while striking golf ball. Consequently, it may result in unwanted deviation of a flying trajectory of a golf ball that decreases accuracy for striking golf ball.

Hence, there is a need for the improvement in the striking plate 2 of No. 2003/0144079. In particular, the horizontal narrow rib 20*a* and the vertical narrow ribs 20*b* of the striking plate 2 must be matched in the elastic deformation. To accomplish this task, it is necessary that the resilient difference between the horizontal narrow rib 20*a* and the vertical narrow ribs 20*b* of the striking plate 2 must be eliminated.

The present invention intends to provide a golf club head having a uniform deformation structure consisting of equal-length buffers each of which is radially extended from a center portion to an outer periphery on a rear surface of a striking plate. Each of the equal-length buffers of the striking plate has an inner end for commonly delimiting a configuration for a striking zone substantially similar to that of the outer periphery of the striking plate in such a way to mitigate and overcome the above problem.

SUMMARY OF THE INVENTION

The primary objective of this invention is to provide a golf club head having a uniform deformation structure consisting of equal-length buffers each of which is radially extended from a center portion to an outer periphery on a rear surface of a striking plate. Each of the equal-length buffers substantially performs an identical elastic deformation, thereby increasing even deformation of the striking plate.

The secondary objective of this invention is to provide the golf club head having a uniform deformation structure consisting of equal-length buffers of a striking plate. Each of equal-length buffers radially extends from a center portion to an outer periphery on a rear surface of the striking plate, and has an inner end adapted to commonly delimit a configuration for a striking zone substantially similar to that of the outer periphery of the striking plate. Thereby, such a configuration of the striking zone may further increase even deformation of the striking plate.

The golf club head in accordance with the present invention includes a golf club head body, a striking plate and a plurality of equal-length buffers. In assembling, the striking plate mechanically connects to a front side of the golf club head body. Each of the equal-length buffers radially extends from a center portion to an outer periphery on a rear surface of the striking plate, and performs identical elastic deformation. Each of the equal-length buffers has an inner end adapted to commonly delimit a configuration for a striking zone substantially similar to that of the outer periphery of the striking plate.

In a separate aspect of the present invention is that the equal-length buffer is a protruded rib having a width gradually increasing from the center portion to the outer periphery of the striking plate.

In a further separate aspect of the present invention is that the equal-length buffer is a protruded rib having a thickness gradually increasing from the center portion to the outer periphery of the striking plate.

In a yet further separate aspect of the present invention is that the equal-length buffer is a recessed groove having a width gradually increasing from the center portion to the outer periphery of the striking plate.

In a yet further separate aspect of the present invention is that the equal-length buffer is a recessed groove having a depth gradually increasing from the center portion to the outer periphery of the striking plate.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE INVENTION

Figure 1:
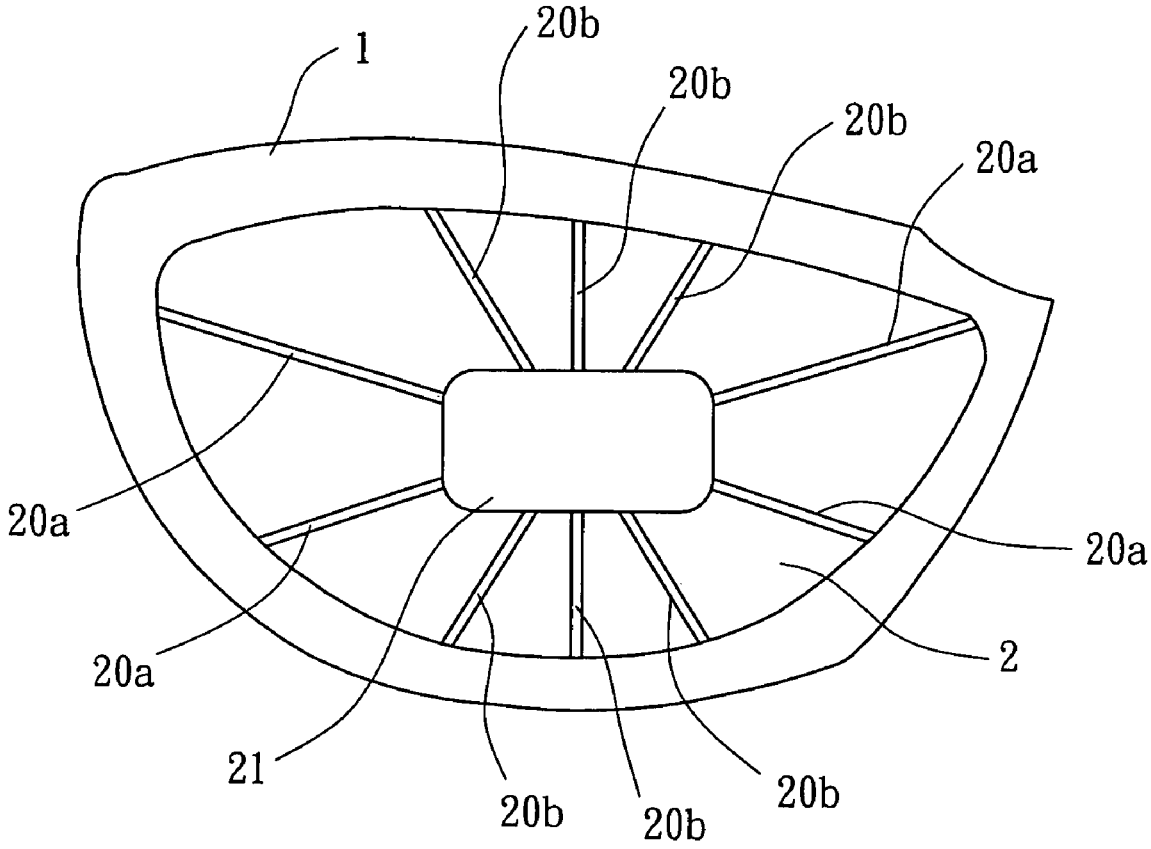
FIG. 1 PRIOR ART
FIG. 1 is a cross-sectional view of a conventional golf club head structure in accordance with prior art.
Figure 2:
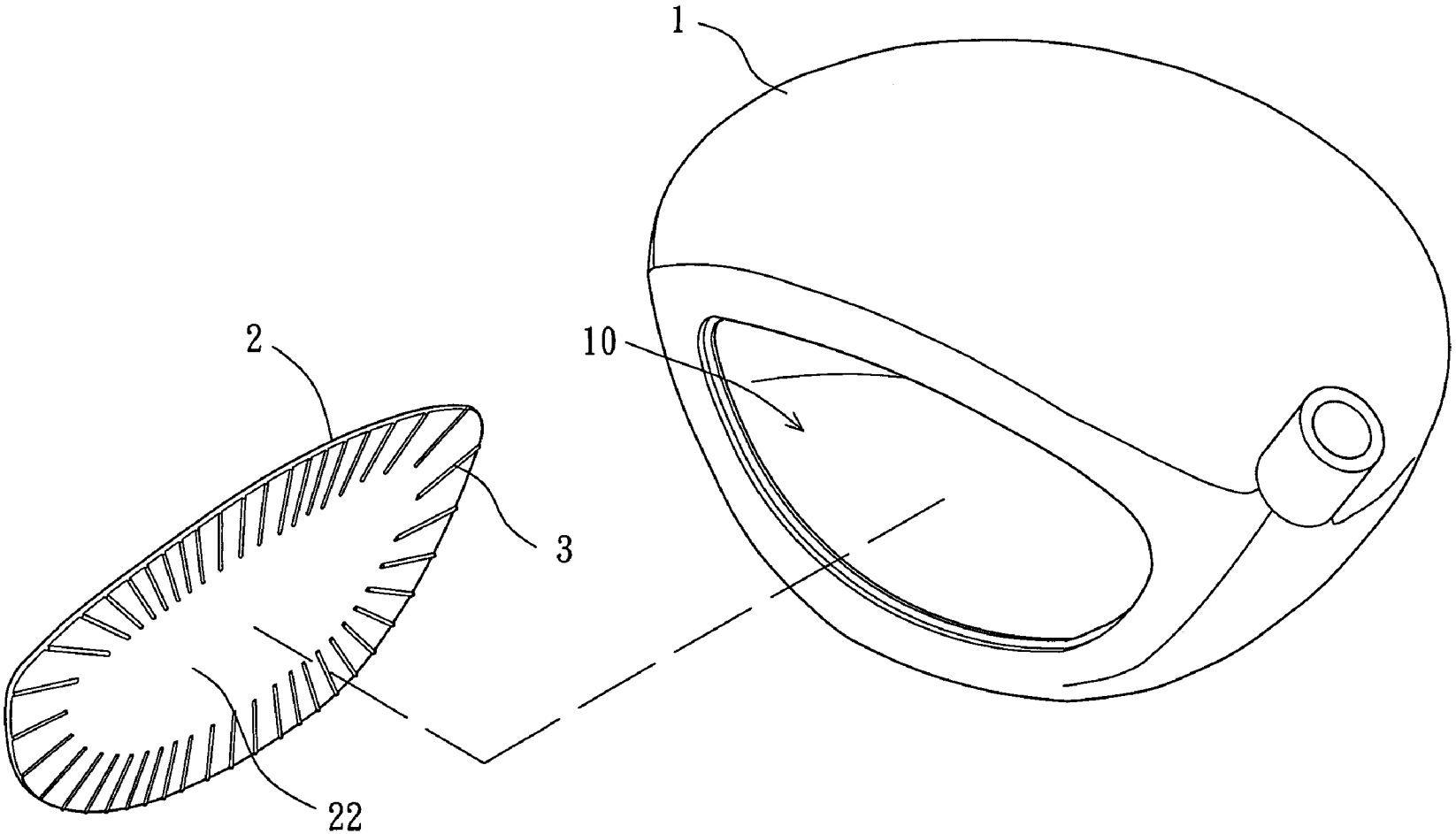
FIG. 2 is an exploded perspective view of a golf club head having a uniform deformation structure in accordance with a first embodiment of the present invention.

Referring to FIG. 2, reference numerals of a first embodiment of the present invention have applied the identical numerals of the conventional golf club head structure, as shown in FIG. 1. The construction of the golf club head structure in accordance with the first embodiment of the present invention has similar configuration and same function as that of the conventional golf club head structure and detailed descriptions may be omitted.

Still referring to FIG. 2, the golf club head in accordance with the first embodiment of the present invention generally includes a golf club head body member designated numeral 1, a striking plate member designated numeral 2 and equal-length buffer member designated numeral 3.

Referring now to FIG. 2, the golf club head includes a golf club head body 1, a striking plate 2 and equal-length buffers 3. In assembling, the striking plate 2 mechanically connects to a front side of the golf club head body 1. The equal-length buffers 3 are provided on an inner surface of the striking plate 2 which further includes an outer surface for confronting with a golf ball (not shown). The equal-length buffers 3 reinforce the entire structure of the striking plate 2.

Still referring to FIG. 2, the construction of the golf club head body 1 shall be described in detail. The golf club head body 1 generally has a basic configuration relatively rigid and strong to withstand normal usage of striking golf ball. And, the golf club head body 1 includes an assembling hole 10 located at its front side. In assembling, the striking plate 2 mechanically connects to the assembling hole 10 of the golf club head body 1. The golf club head body 1 further includes a sole portion, a side wall portion and a crown portion (not labeled).

Referring now to FIGS. 1 and 2, the construction of the striking plate 2 shall be described in detail. Typically, the striking plate 2 is made of metal or alloy (such as titanium) with high coefficient of resilience (C.O.R.). The striking plate 2 consists of the outer surface regarded as a front surface and the inner surface regarded as a rear surface. Defined between the outer surface and the inner surface are a predetermined thickness. When striking golf ball, the thickness of the striking plate 2 performs an adequate elastic deformation. The front surface of the striking plate 2 is adapted to confront with a golf ball and the rear surface adapted to provide the uniform deformation structure.

Still referring to FIGS. 1 and 2, the construction of the equal-length buffers 3 shall be described in detail. The equal-length buffer 3 is a protruded rib projected from the rear surface of the striking plate 2. In assembling, the equal-length buffers 3 are correspondingly adjacent to a rim of the assembling hole 10 of the golf club head body 1. When striking golf ball, the equal-length buffers 3 obstruct stress force of the striking plate 2 directly transmitting to the rim of the assembling hole 10 of the golf club head body 1. Accordingly, maintaining the majority stress force can adequately deform the striking plate 2. Consequently, the striking plate 2 is able to return the entire striking energy to a golf ball that may increase a striking distance.

Figure 3:
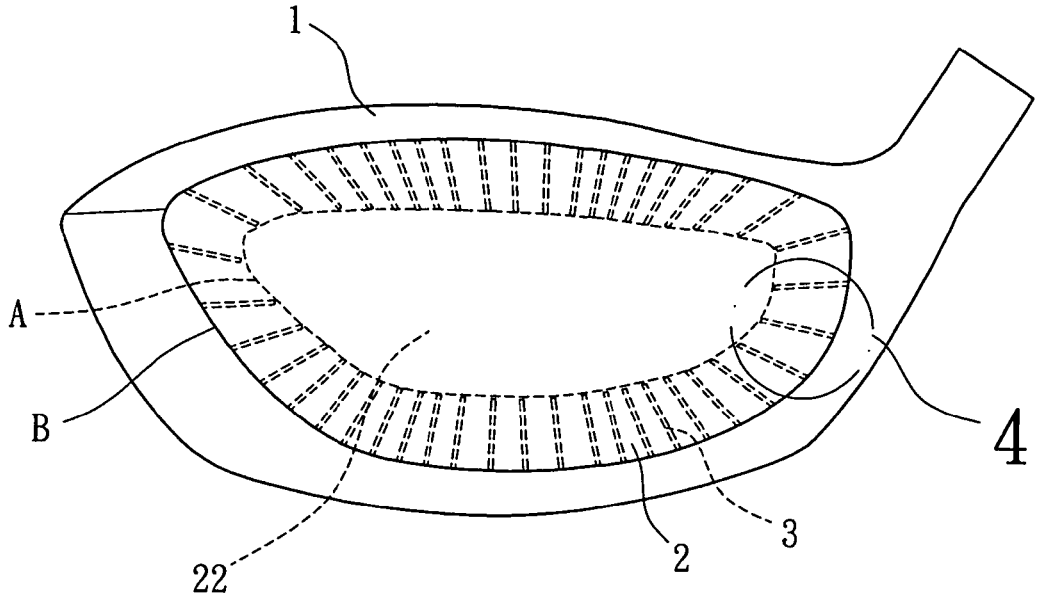
FIG. 3 is a front elevation view of the golf club head having the uniform deformation structure in accordance with the first embodiment of the present invention.
Figure 4:
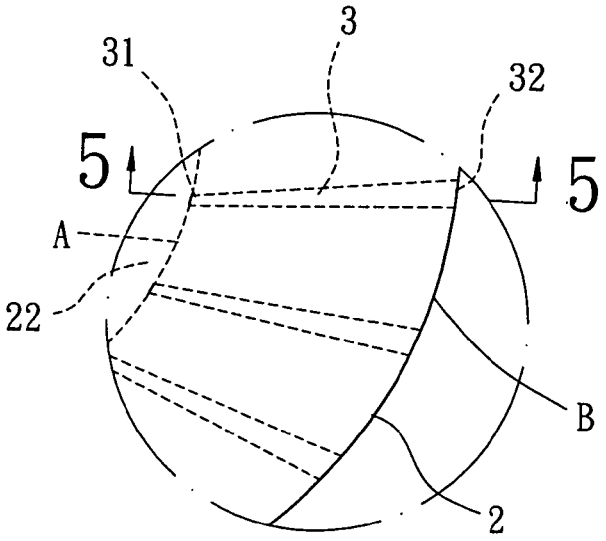
FIG. 4 is a fragmental enlarged view, in FIG. 3, of the striking plate of the golf club head structure in accordance with the first embodiment of the present invention.

Turning now to FIGS. 3 and 4, each of the protruded ribs of the equal-length buffers 3 forms an inner end 31 and an outer end 32 integrally connected to the inner end 31. The protruded ribs of the equal-length buffers 3 are disposed on the rear surface of the striking plate 2 and spaced apart from each other, and thus adapted to reinforce the striking plate 2. Each of the equal-length buffers 3 radially extends from a center portion to an outer periphery on the rear surface of the striking plate 2, and performs identical elastic deformation. Since each of the protruded ribs of the equal-length buffers 3 can substantially perform identical elastic deformation, the outer periphery of the striking plate 2 thereby performs even mechanical characteristic. Additionally, the inner ends 31 of the equal-length buffers 3 commonly delimit a configuration for a central striking zone 22, as indicated at dotted line "A" in FIG. 3, substantially similar to that of the outer periphery of the striking plate 2, as indicated at line "B" in FIG. 3. Namely, the central striking zone 22 with same configuration as that of the outer periphery of the striking plate 2 is provided.

Still referring to FIG. 4, changes in width of each protruded rib of the equal-length buffers 3 are permitted. Preferably, the protruded rib of the equal-length buffer 3 has a width gradually increasing from the inner end 31 to the outer end 32. Namely, the width of the protruded rib proximate the center portion of the striking plate 2 is greater than that proximate the outer periphery of the striking plate 2. When striking golf ball, changes in width of each of the equal-length buffers 3 further prevent the stress force directly transmitting to the rim of the assembling hole 10 of the golf club head body 1. Accordingly, the striking plate 2 can be adequately deformed.

Figure 5:
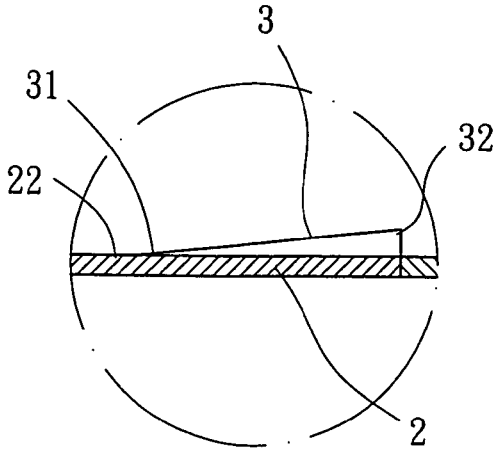
FIG. 5 is a cross-sectional view, taken along line 5—5 in FIG. 4, of the striking plate of the golf club head in accordance with the first embodiment of the present invention.

Turning now to FIG. 5, changes in thickness of each protruded rib of the equal-length buffers 3 are permitted. Preferably, the protruded rib of the equal-length buffer 3 has a thickness gradually increasing from the inner end 31 to the outer end 32. Namely, the thickness of the protruded rib proximate the center portion of the striking plate 2 is greater than that proximate the outer periphery of the striking plate 2. When striking golf ball, changes in thickness of each of the equal-length buffers 3 further prevent the stress force directly transmitting to the rim of the assembling hole 10 of the golf club head body 1. Accordingly, the striking plate 2 can be adequately deformed. More preferably, the thickness of the protruded rib ranges between 0 and 30 mm.

Figure 6:
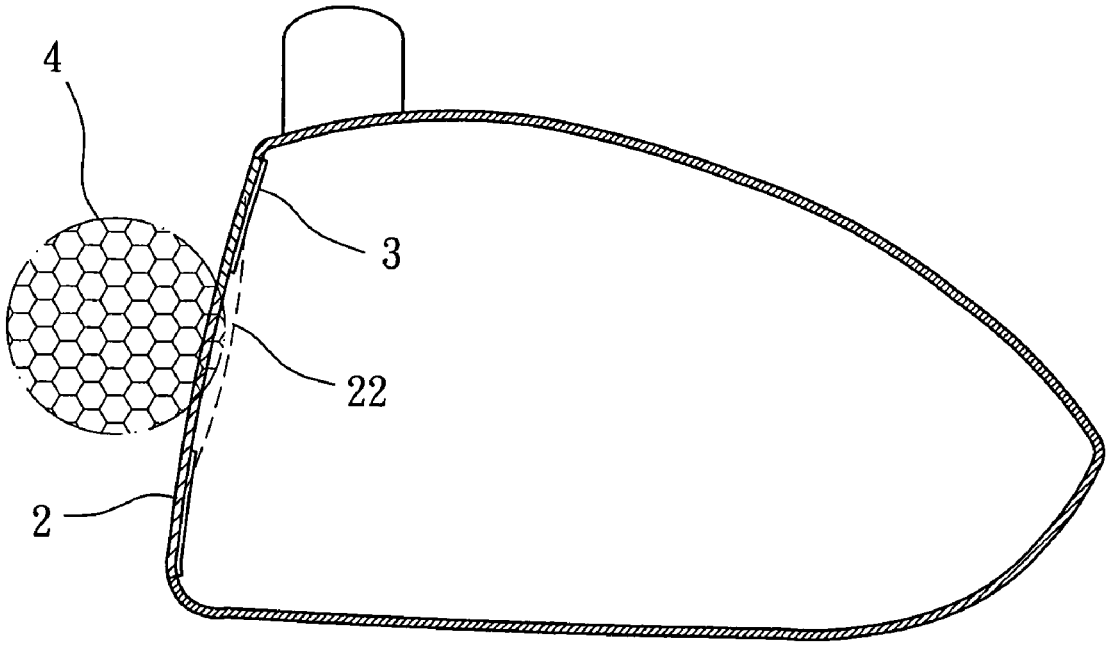
FIG. 6 is a side elevation view of the striking plate of the golf club head impacting a golf ball in accordance with the first embodiment of the present invention.

Turning now to FIG. 6, the central striking zone 22 with the same peripheral configuration of the striking plate 2 is suitable for striking golf ball. Correspondingly, the equal-length buffers 3 can attenuate the stress force directly transmitting to the rim of the assembling hole 10 of the golf club head body 1. When striking golf ball, a golf ball 4 impacts the central striking zone 22 and thus the striking plate 2 is elastically deformed. Subsequently, the equal-length buffers 3 obstruct the stress force of the striking plate 2 directly transmitting to the rim of the assembling hole 10 of the golf club head body 1. Then, the central striking zone 22 returns to rebound the golf ball 4 off the striking plate 2, and thus exerts all striking energy on the golf ball 4. Consequently, it may extend a striking distance of the golf club head.

Figure 7:
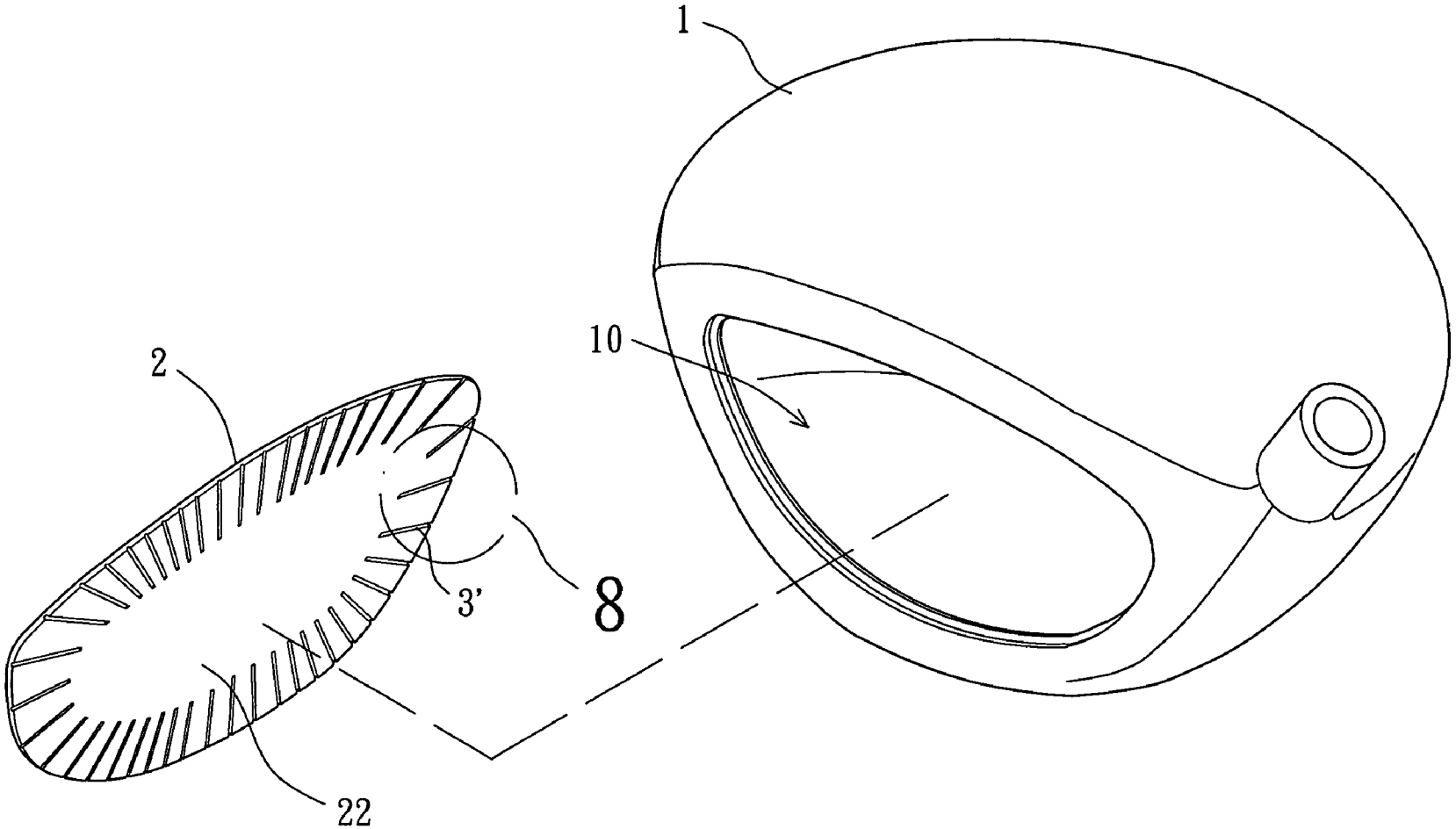
FIG. 7 is an exploded perspective view of a golf club head having a uniform deformation structure in accordance with a second embodiment of the present invention.

Turning now to FIG. 7, reference numerals of the second embodiment of the present invention have applied the identical numerals of the first embodiment, as shown in FIGS. 2–6. The construction of the golf club head structure in accordance with the second embodiment of the present invention has similar configuration and same function as that of the golf club head structure of the first embodiment and detailed descriptions may be omitted.

Referring again to FIG. 7, in comparison with the first embodiment, the equal-length buffers 3' of the second embodiment is a recessed groove recessed on the rear surface of the striking plate 2. When striking golf ball, a golf ball 4 impacts the central striking zone 22 and thus the striking plate 2 is elastically deformed, as best shown in FIG. 6. Subsequently, the equal-length buffers 3' obstruct the stress force of the striking plate 2 directly transmitting to the rim of the assembling hole 10 of the golf club head body 1. Then, the central striking zone 22 returns to rebound the golf ball 4 off the striking plate 2, and thus exerts all striking energy on the golf ball 4. Consequently, it may extend a striking distance of the golf club head.

Figure 8:
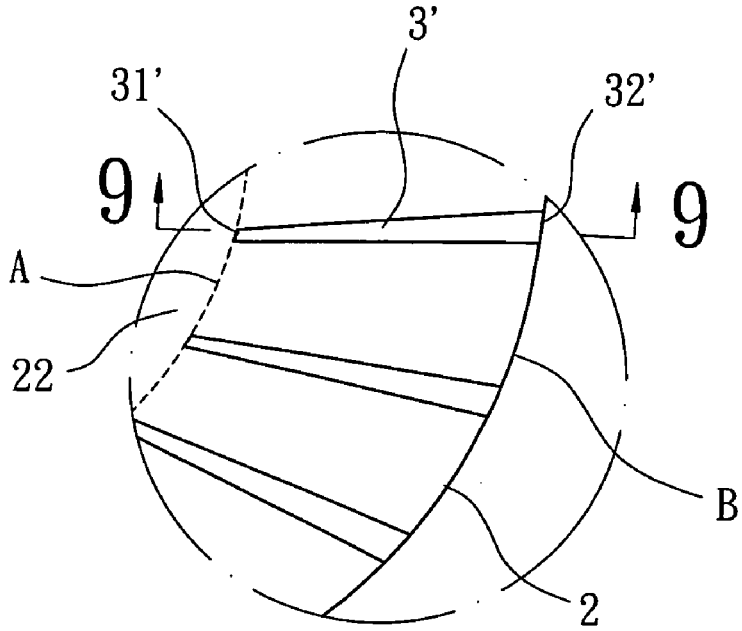
FIG. 8 is a fragmental enlarged view, in FIG. 7, of the striking plate of the golf club head structure in accordance with the second embodiment of the present invention.

Still referring to FIG. 8, changes in width of each recessed groove of the equal-length buffers 3' are permitted. Preferably, the recessed rib of the equal-length buffer 3' has a width gradually increasing from the inner end 31' to the outer end 32'. Namely, the width of the recessed groove proximate the center portion of the striking plate 2 is greater than that proximate the outer periphery of the striking plate 2. When striking golf ball, changes in width of each of the equal-length buffers 3' further prevent the stress force directly transmitting to the rim of the assembling hole 10 of the golf club head body 1. Accordingly, the striking plate 2 can be adequately deformed.

Figure 9:
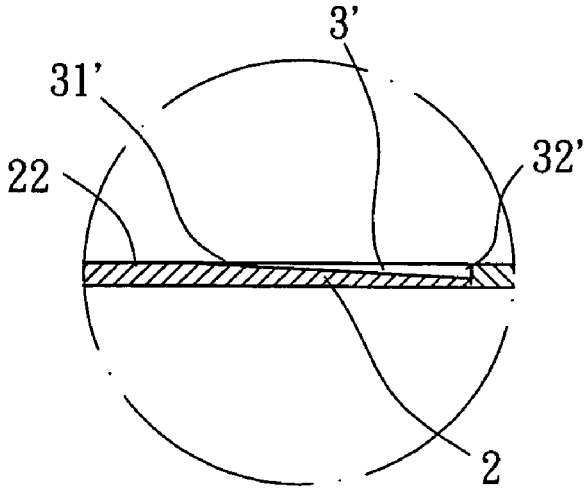
FIG. 9 is a cross-sectional view, taken along line 9—9 in FIG. 8, of the striking plate of the golf club head in accordance with the second embodiment of the present invention.

Turning now to FIG. 9, changes in depth of each recessed groove of the equal-length buffers 3' are permitted. Preferably, the recessed groove of the equal-length buffer 3' has a depth gradually increasing from the inner end 31' to the outer end 32'. Namely, the depth of the protruded rib proximate the center portion of the striking plate 2 is greater than that proximate the outer periphery of the striking plate 2. When striking golf ball, changes in depth of each of the equal-length buffers 3' further prevent the stress force directly transmitting to the rim of the assembling hole 10 of the golf club head body 1. Accordingly, the striking plate 2 can be adequately deformed. More preferably, the depth of the protruded rib ranges between 0 and 30 mm.

Referring back to FIG. 1, as has been described, the conventional golf club head has a resilient difference between the horizontal narrow rib 20*a* and the vertical narrow ribs 20*b* of the striking plate 2 that may cause uneven elastic deformation. Accordingly, it is a disadvantage of the conventional golf club head resulting in unwanted deviation of a flying trajectory of a golf ball.

Referring back to FIG. 2, the striking plate 2 of the present invention employs the equal-length buffers 3 each of which substantially performing an identical elastic deformation, thereby increasing even deformation of the striking plate. Each of equal-length buffers 3 has an inner end 31 adapted to commonly delimit the striking zone 22 with similar outer periphery of the striking plate 2 may further increase even deformation of the striking plate 2.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A golf club head having a uniform deformation structure, comprising:

a golf club head body including an assembling hole at its front side;

a striking plate including an outer surface and an inner surface, the striking plate connected to the assembling hole of the front side of the golf club head body; and a plurality of the equal-length buffers spaced apart from each other on an outer periphery of the inner surface of the striking plate, each of the equal-length buffers having an inner end and an outer end;

wherein each of said equal-length buffers radially extends from a center portion to an outer periphery of the striking plate, wherein each of the equal-length buffers is a protruded rib projected from the inner surface of the striking plate, and has a width gradually increasing from the inner end to the outer end.

2. The golf club head having the uniform deformation structure as defined in claim 1, wherein the inner ends of the equal-length buffers commonly delimit a configuration for a striking zone substantially similar to that of the outer periphery of the striking plate.

3. The golf club head having the uniform deformation structure as defined in claim 1, wherein each of the protruded ribs of the equal-length buffers has a thickness gradually increasing from the inner end to the outer end; and wherein, when striking golf ball, changes in thickness of each of the equal-length buffers further prevent the stress force directly transmitting to the rim of the assembling hole of the golf club head body.

4. The golf club head having the uniform deformation structure as defined in claim 3, wherein the thickness of the protruded rib ranges between 0 and 30 mm.

* * * * *